US012575656B2

(12) United States Patent
Voltz et al.

(10) Patent No.: US 12,575,656 B2
(45) **Date of Patent: *Mar. 17, 2026**

(54) SYSTEM, APPARATUS, AND METHOD FOR THREADING A BEADER TOOL WITH HAIR BEADS

(71) Applicants: Kia-Shun Voltz, Cedar Hill, TX (US); Carolyn Manson, Bradenton, FL (US)

(72) Inventors: Kia-Shun Voltz, Cedar Hill, TX (US); Carolyn Manson, Bradenton, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/055,970

(22) Filed: Feb. 18, 2025

(65) Prior Publication Data

US 2025/0228346 A1 Jul. 17, 2025

Related U.S. Application Data

(63) Continuation of application No. 18/589,017, filed on Feb. 27, 2024, now Pat. No. 12,226,003.

(60) Provisional application No. 63/620,547, filed on Jan. 12, 2024.

(51) Int. Cl.

| | |
|---|---|
| ***A45D 8/00*** | (2006.01) |
| ***D04D 1/04*** | (2006.01) |
| *A45D 2/00* | (2006.01) |
| *A45D 7/00* | (2006.01) |

(52) U.S. Cl.

CPC ..... *A45D 8/008* (2021.01); *D04D 1/04* (2013.01); *A45D 2002/008* (2013.01); *A45D 2007/004* (2013.01)

(58) Field of Classification Search

CPC ..... D04D 1/04; D04D 9/00; A45D 2002/008; A45D 8/008; A44C 27/00

See application file for complete search history.

(56) References Cited

U.S. PATENT DOCUMENTS

| | | | | |
|---|---|---|---|---|
| 142,786 | A * | 9/1873 | Hinckley | B65H 35/0006 223/107 |
| 752,626 | A * | 2/1904 | Law | D04D 9/00 223/48 |
| 1,151,873 | A | 8/1915 | Graham | |
| 1,293,660 | A | 2/1919 | Armstrong | |
| 1,417,713 | A * | 5/1922 | Bolls | D04D 9/00 223/48 |
| 2,087,481 | A * | 7/1937 | Roby | H01B 13/18 29/241 |

(Continued)

*Primary Examiner* — Nathan E Durham

(74) *Attorney, Agent, or Firm* — Scott Griggs; Griggs Bergen LLP

(57) ABSTRACT

A shaft, apparatus, and method for threading a beader tool with hair beads are disclosed. In one embodiment of the apparatus, multiple silos form an array with each silo being sized to allow the passage of a beader tool while preventing hair beads from escaping. The interior of each silo is tailored to accommodate a stack of hair beads, with the height of the silos being sufficient to house at least the shaft of the beader tool. A support structure secures the array of silos in an upward orientation. This support structure takes the form of a box, which defines a chamber beneath the array of silos. The chamber is designed with a height that can accommodate at least a loop of the beader tool and includes a drawer for additional utility. This apparatus presents a practical and innovative solution for simplifying the process of threading hair beads.

19 Claims, 9 Drawing Sheets

(56) References Cited

U.S. PATENT DOCUMENTS

| | | | |
|---|---|---|---|
| 4,102,478 | A | 7/1978 | Samoilov |
| 4,863,079 | A | 9/1989 | Holmgren |
| 5,967,151 | A | 10/1999 | Villani et al. |
| 8,851,086 | B2 | 10/2014 | Stachowski |
| 10,364,094 | B2 | 7/2019 | Carlson |
| 2004/0177859 | A1 | 9/2004 | Coleman |
| 2015/0252502 | A1 | 9/2015 | Kollmar |

* cited by examiner

SYSTEM, APPARATUS, AND METHOD FOR THREADING A BEADER TOOL WITH HAIR BEADS

PRIORITY STATEMENT & CROSS-REFERENCE TO RELATED APPLICATIONS

This application claims priority from U.S. application Ser. No. 18/589,017, entitled "System, Apparatus and Method for Threading a Beader Tool with Hair Beads" and filed on Feb. 27, 2024, in the name of Kia-Shun Voltz et al., now U.S. Pat. No. 12,226,003, issued on Feb. 18, 2025; which claims priority from U.S. Provisional Patent Application No. 63/620,547, entitled "System, Apparatus and Method for Threading a Beader Tool with Hair Beads" and filed on Jan. 12, 2024, in the name of Kia-Shun Voltz et al.; both of which are hereby incorporated by reference, in entirety, for all purposes.

TECHNICAL FIELD OF THE INVENTION

This invention relates, in general, to the domain of hairstyling accessories and, in particular, to a system, apparatus, and method for threading a beader tool with hair beads for styling hair.

BACKGROUND OF THE INVENTION

In the realm of hair styling, particularly when it involves the use of hair beads, there exists a time-consuming and meticulous task: threading the hair beads onto a beader tool. This process is typically manual, requiring significant dexterity and patience, especially when dealing with a large number of hair beads. Each bead must be individually picked up and threaded onto the tool, a task that can be quite challenging, especially for individuals with limited manual dexterity or for stylists working under time constraints. The traditional method of threading hair beads involves picking up each bead separately, aligning it with the end of the beader tool, and then sliding it onto the tool. This can be a slow and frustrating process, often compounded by the small size of the hair beads and the precision required to successfully thread them without dropping or misaligning. Furthermore, the repetitive nature of this task can lead to physical strain, particularly in the fingers and hands, making it a less than ideal activity for those who engage in bead threading frequently.

Given these challenges, there is a need for an improved approach to threading hair beads. The ideal solution would not only expedite the process but also reduce the manual dexterity required, making it accessible to a wider range of users. Additionally, such an innovation should minimize physical strain and enhance the overall efficiency and enjoyment of the hair beading process. This background sets the stage for the introduction of an apparatus designed to meet these needs, offering a more streamlined, less tedious method for threading hair beads onto a beader tool.

SUMMARY OF THE INVENTION

It would be advantageous to achieve a system, apparatus, and method that may be utilized when threading a beader tool with hair beads. It would also be desirable to enable a mechanical solution that satisfies comfort while mitigating or eliminating the tedium associated with a traditional process. It would be further desirable to enhance convenience and speed. To better address one or more of these concerns, a system, apparatus, and method for threading a beader tool with hair beads are disclosed.

In one embodiment of the apparatus, multiple silos form an array with each silo being sized to allow the passage of a beader tool while preventing hair beads from escaping. The interior of each silo is tailored to accommodate a stack of hair beads, with the height of the silos being sufficient to house at least the shaft of the beader tool. A support structure secures the array of silos in an upward orientation. This support structure takes the form of a box, which defines a chamber beneath the array of silos. The chamber is designed with a height that can accommodate at least a loop of the beader tool and includes a drawer for additional utility. This apparatus presents a practical and innovative solution for simplifying the process of threading hair beads.

Various embodiments include a hexagon-shaped or heart-shaped design, for example, incorporating different materials and shapes for aesthetic and ergonomic advantages. The system's flexibility extends to the use of traditional materials or sustainable materials and modular designs, catering to eco-conscious practices and extending product lifespan. Beyond hair beading, the system is adaptable for crafting or jewelry-making, with silo and beader tool modifications to suit different bead sizes and types. This versatility expands the product's market potential and ensures relevance in diverse creative domains. The invention's design variations include differently shaped and angled silos, enhancing bead dispensing and user visibility. This adaptability makes the invention suitable for various scenarios and user preferences. Overall, this invention significantly improves the hair beading process, offering an efficient, user-friendly, and versatile solution. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

Figure 1A:
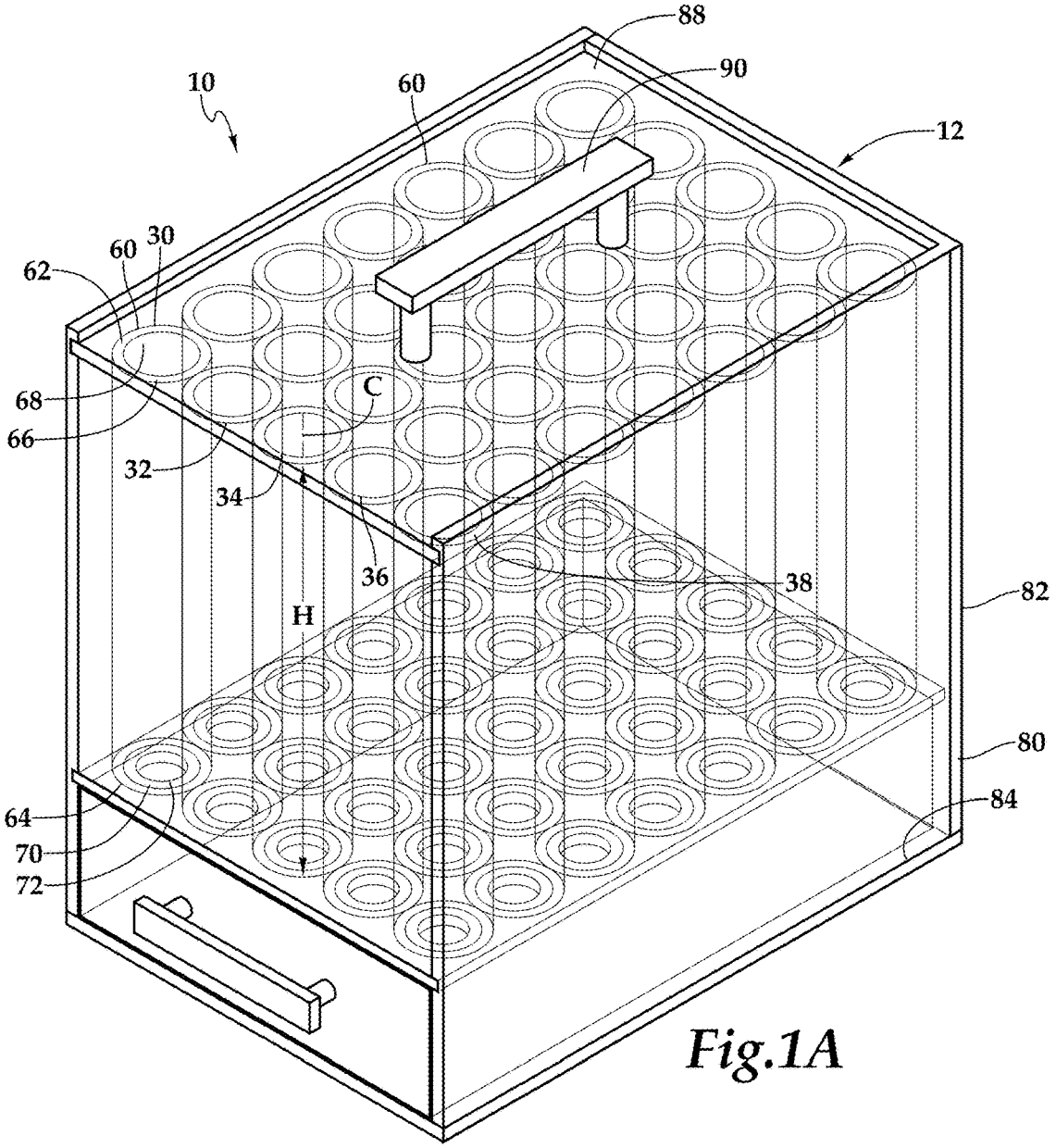
FIG. 1A and FIG. 1B, collectively, are a front perspective view of one embodiment of a system for threading a beader tool with hair beads to add hair beads to a child's or adult's hair, for example, according to some of the teachings presented herein.
Figure 1B:
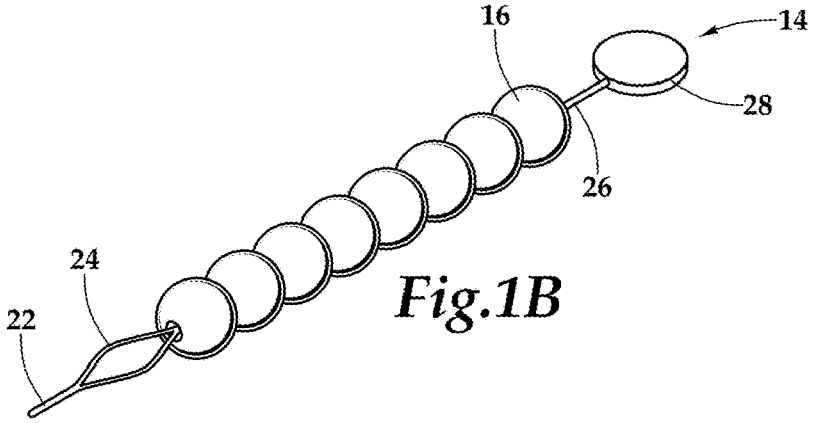

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention and do not delimit the scope of the present invention.

Referring now to FIG. 1A through FIG. 6, therein is depicted one embodiment a system 10, including an apparatus 12, for threading a beader tool 14 with hair beads 16 to add hair beads 16 to a child's or other individual's hair. The apparatus 12 holds multiple stacks 20 of hair beads 16, which significantly simplifies the traditionally manual and time-consuming process of threading the hair beads 16 onto hair. The beader tool 14 includes a threading end 22, a flexible loop 24, a shaft 26, and a terminal end 28. The threading end 22 is specifically designed to ease passage through the hair beads 16, while the flexible loop 24 is designed to temporarily expand and contract, aiding in bead retention during the threading process. The shaft 26 is sized to hold an adequate number of hair beads 16, balancing capacity with maneuverability. In operation, hair beads 16 are stacked in a silo 30, for example, of the apparatus 12, and a user inserts the threading end 22 of the beader tool 14 into the silo 30, and advances it through, allowing hair beads 16 to stack onto the shaft 26. Once the desired number of hair beads 16 is collected on the shaft 26, the beader tool 14 is withdrawn, ready for threading these hair beads onto hair, thereby streamlining the entire process of bead application.

Continuing to refer to FIG. 1A through FIG. 6, in some embodiments, as mentioned, the apparatus 12 includes silos, such as the aforementioned silo and silos 30, 32, 34, 36, 38, forming an array 60, which may be any number of silos, including any number of rows and columns. With respect to the silo 30 as an example of the silos 30, 32, 34, 36, 38, the silo 30 includes a height H with a cross-section C, which in some embodiments is a circle having a diameter, but may be any shape. The silo 30 also includes an upper end 62 and a lower end 64. The upper end 62 may be open 66 and sized to permit the passage of a hair bead 16 into an interior 68 of the silo 30. The lower end 64 may be closed 70 with an opening 72 therethrough. As will be discussed below in additional detail, the opening 72 is sized to permit the beader tool 14 therethrough while preventing passage of a hair bead 16. In the illustrated embodiment, the silo 30 has the height H to accommodate at least the shaft 26 of the beader tool 14.

A support structure 80 is secured to the array 60 such that the upper end 62 of the silo 30 is oriented upwardly. In some embodiments, as shown by the illustrated embodiment, the support structure 80 is a box 82 defining a chamber 84 inferior to the array 60. The chamber 84 may have a height T of at least the flexible loop 24 of the beader tool 14. As shown, the box 82 includes a drawer 86. A removable lid 88 is designed to cover the silos 30, 32, 34, 36, 38. Further, as shown, the removable lid 88 may have a handle 90 affixed thereto for easy carrying. That is, the removable lid 88 with the affixed handle 90 is designed to cover the silos 30, 32, 34, 36, 38 securely such that the lid 88 not only protects the hair beads 16 from external elements, but also adds to the portability of the apparatus. The handle 90 on the lid 88 enhances user convenience, allowing for easy removal and placement.

Figure 2:
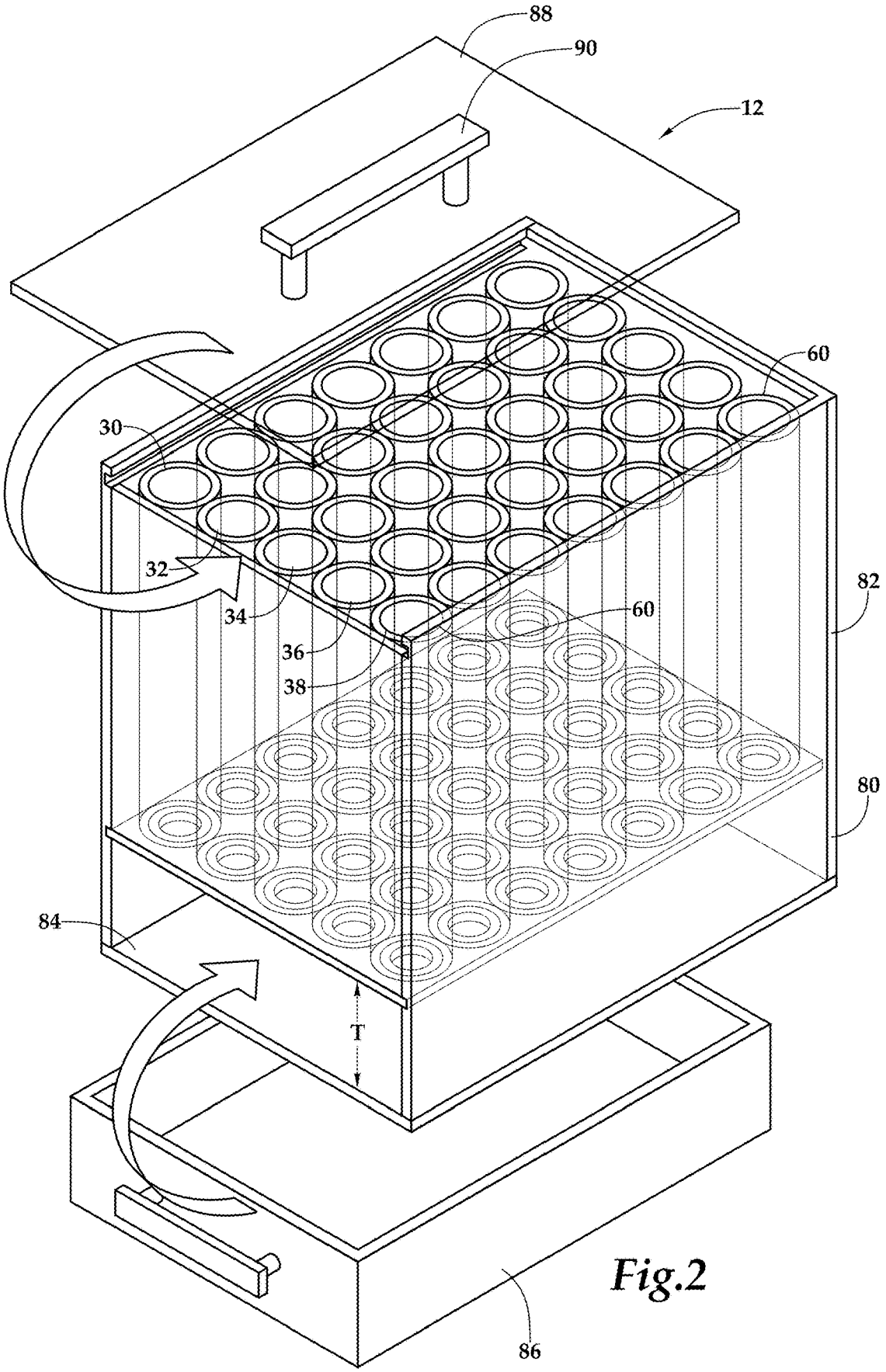
FIG. 2 is a front perspective, partially exploded view of one embodiment of an apparatus for threading a beader tool with hair beads, which forms a portion of the system depicted in FIG. 1A, in a bead loaded configuration.
Figure 3:
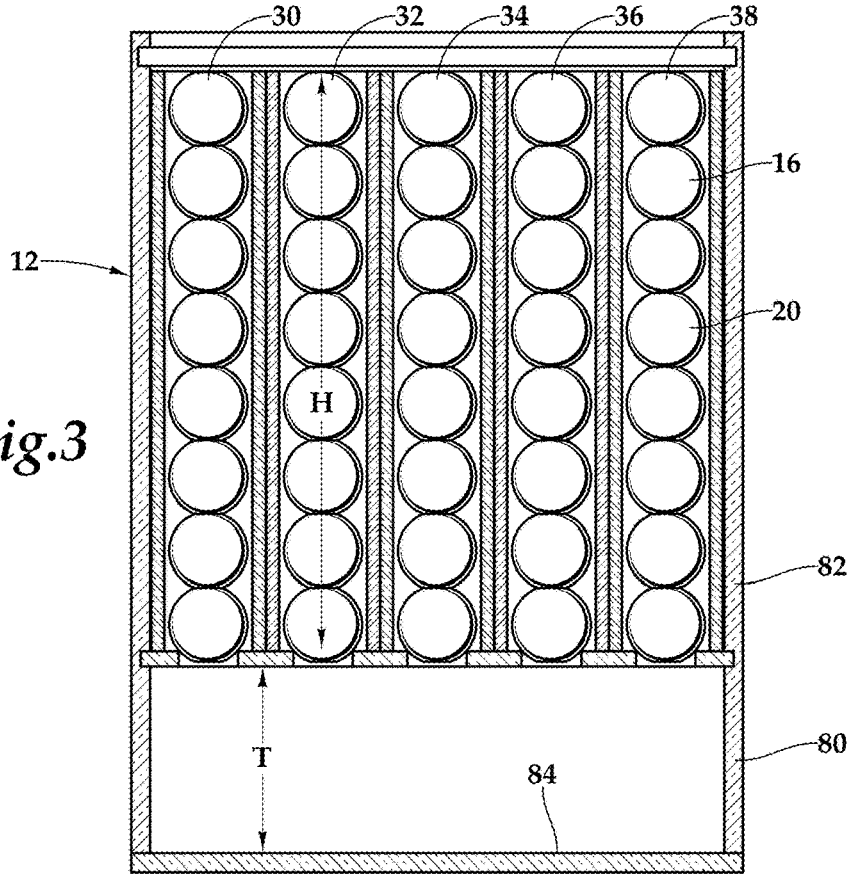
FIG. 3 is a front elevation view of the apparatus depicted in FIG. 1A, in a bead loaded configuration.
Figure 4:
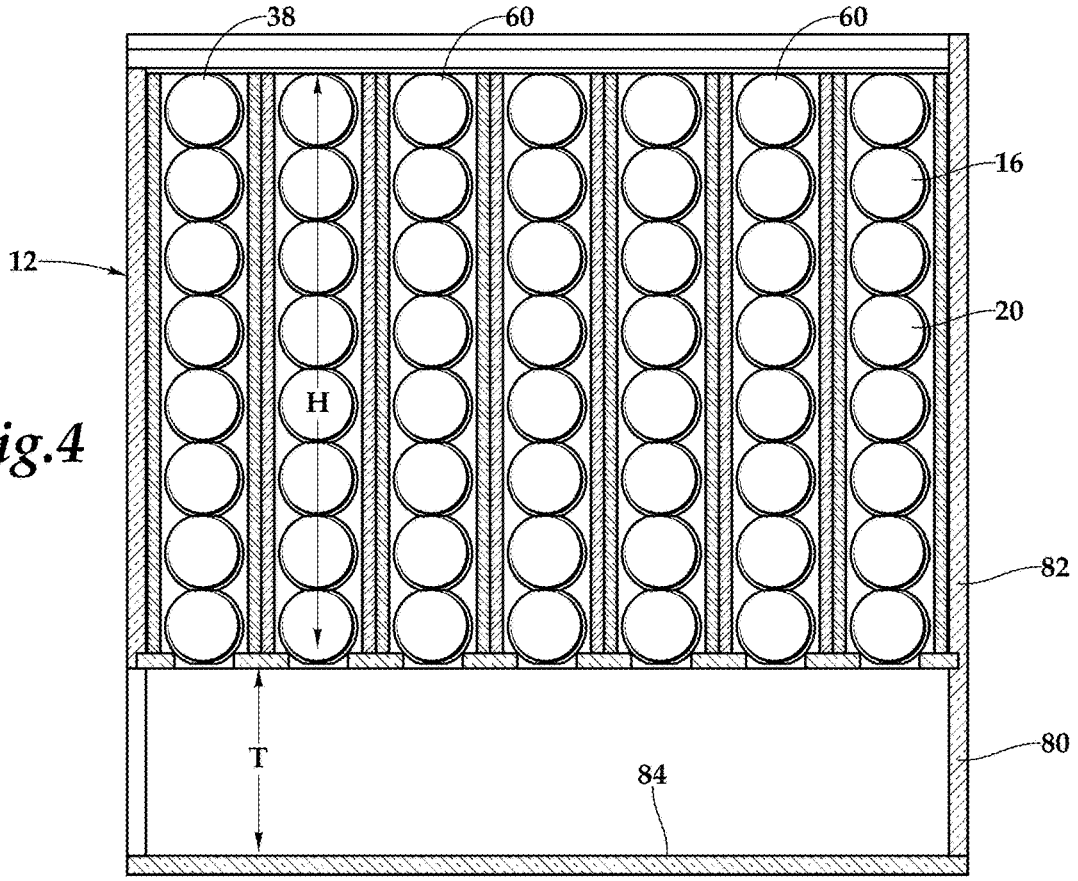
FIG. 4 is a side elevation view of the apparatus depicted in FIG. 1A, in a bead loaded configuration.
Figure 5:
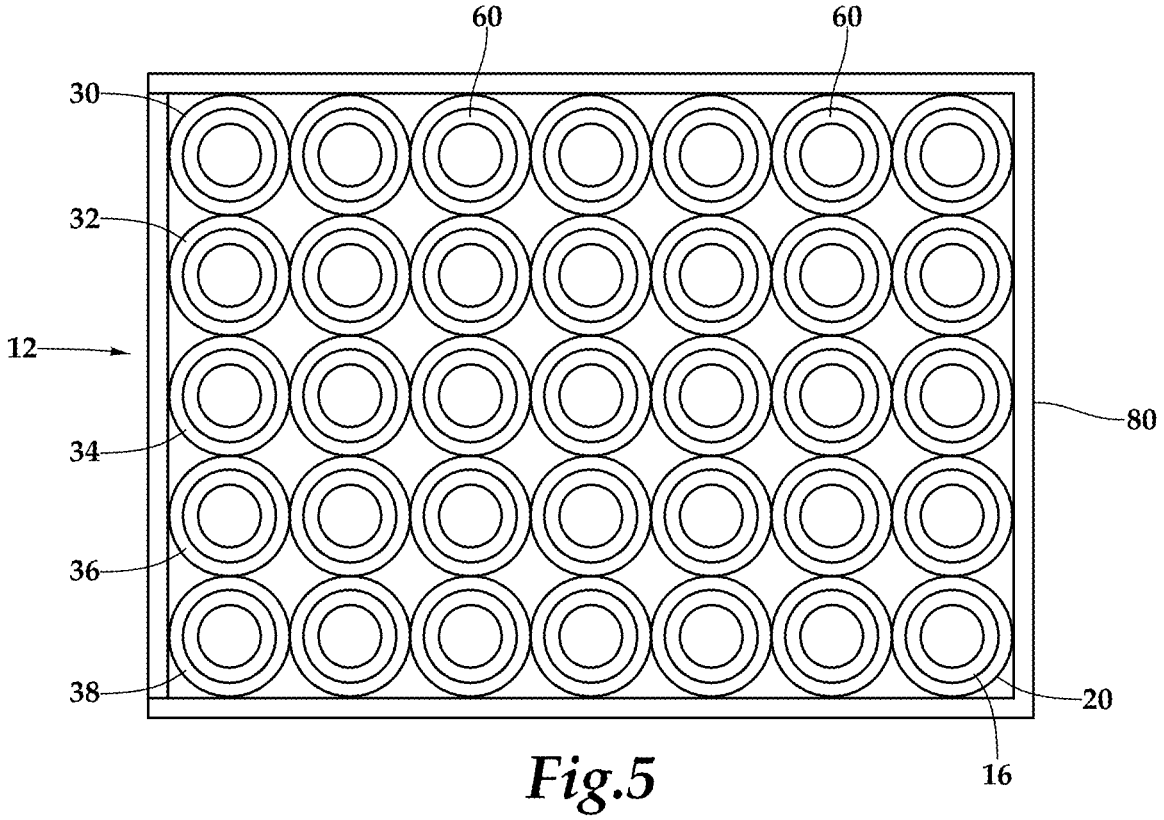
FIG. 5 is a top plan view of the apparatus depicted in FIG. 3, in a bead loaded configuration.
Figure 7:
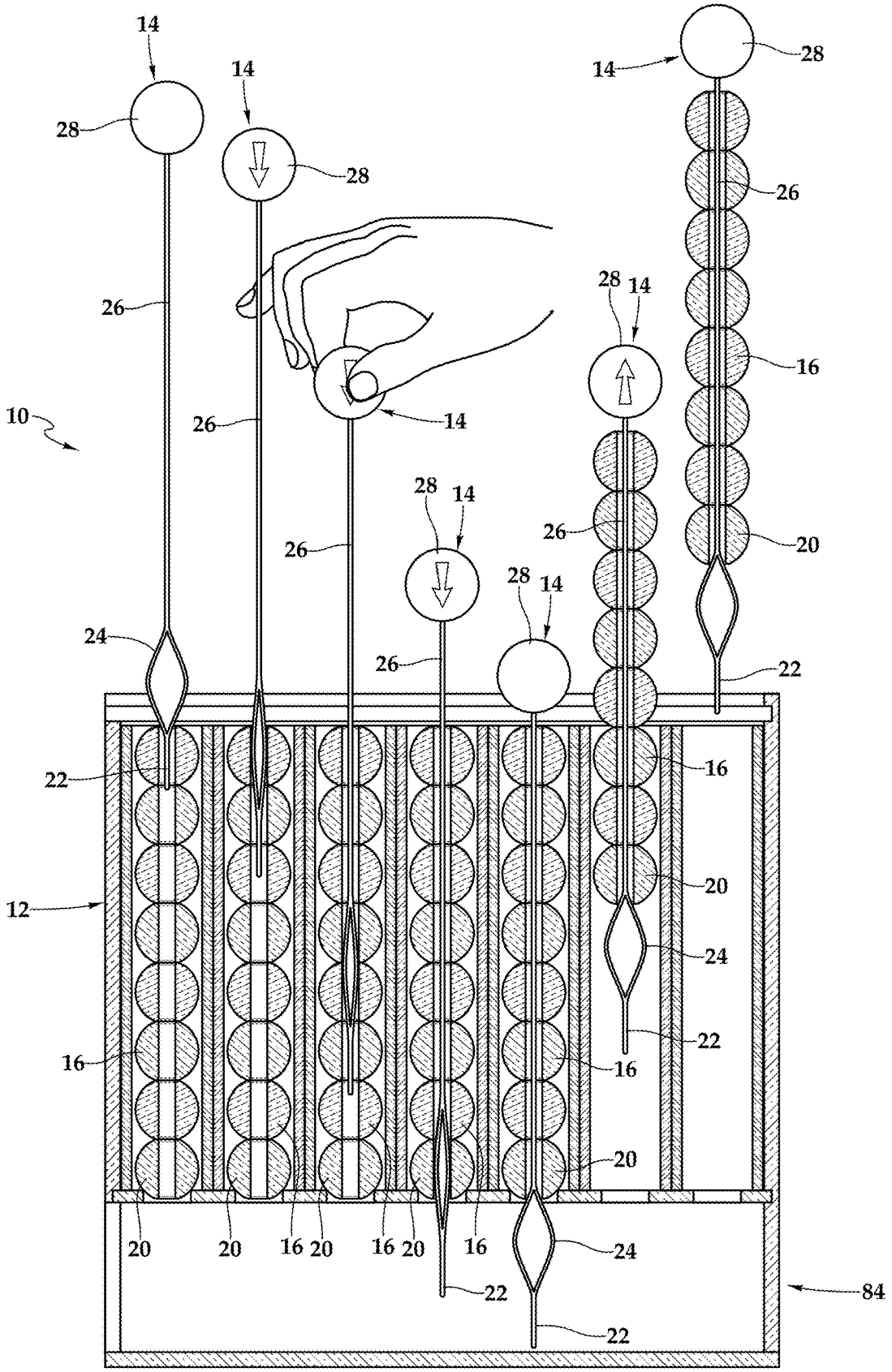
FIG. 7 is a front elevation view, in partial cross-section, of the apparatus depicted in FIG. 1A showing certain operational phases of the use of the apparatus.

Referring now to FIG. 7, in operation, the system 10 facilitates an efficient and user-friendly method for adding hair beads 16 to hair, such as a child's hair or an adult's hair Initially, the hair beads 16 are pre-loaded or loaded by a user into the silos 30, 32, 34, 36, 38, (as shown in FIG. 1A) or a portion thereof of the apparatus 12. As discussed, each silo, as exemplified by silo 30, is designed to store a specific quantity of hair beads 16, with its open upper end 62 (as shown in FIG. 1A) allowing for easy bead insertion into the interior 68 (as shown in FIG. 1A), wherein the hair beads 16 are suspended in the silo 30 by way of the closed lower end 64 (as shown in FIG. 1A) having the opening 72 (as shown in FIG. 1A). Once loaded, the user can then utilize beader tool 14, which has a design to interact with these silos. The user inserts the threading end 22 of beader tool 14 into the open upper end 62 of the silo 30, for example, and beader tool 14 is advanced through the silo 30, and the beader tool 14 collects the hair beads 16 onto its shaft 26 as it advances downward through holes, for example, hole 100, in the hair beads 16. At the lower end, due to the precise sizing of opening 72, the threading end 22 of the beader tool 14 passes through while hair beads 16 are retained within the silo 30. As the beader tool 14 advances, the desired number of hair beads 16 are collected on the shaft 26 and the flexible loop 24, which has been in a compressed position, opens and expands into the chamber 84 (as shown in FIG. 2). Once the beader tool 14 is fully loaded, the beader tool 14 is reversed and then pulled upward out of the silo 30. As the beader tool 14 is pulled out of the silo 30, the hair beads are retained on the shaft 26.

After collecting the desired number of hair beads 16 on the shaft 26, the user then threads hair through the flexible loop 24 of beader tool 14. This flexible loop 24 allows for easy and efficient threading of the hair. Finally, the user pulls beader tool 14 along the length of the hair, sliding hair beads 16 from the shaft 26 onto the hair. This process is made more efficient by the ergonomic design of the beader tool 14, which includes a comfortable terminal end 28 for gripping. The hair beads 16 are thus evenly and aesthetically distributed along hair, completing the beading process.

Figure 8:
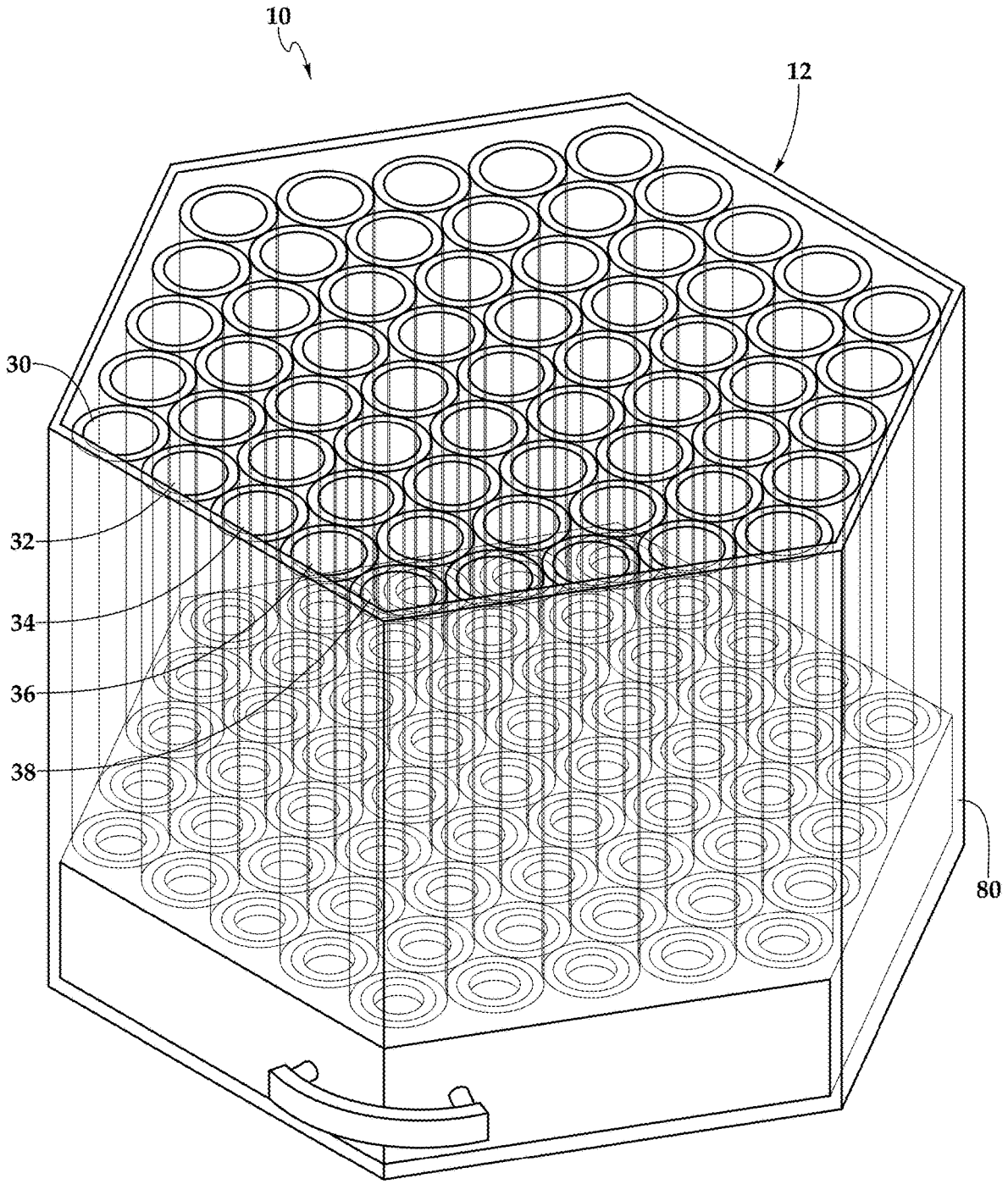
FIG. 8 is a front perspective view of another embodiment of an apparatus for threading a beader tool with hair beads.

Referring now to FIG. 8, an alternate embodiment of the system 10 is presented, showcasing the apparatus 12 designed with a distinct hexagon shape. This embodiment, while maintaining the fundamental functionality of the original design, introduces a unique aesthetic appeal and ergonomic advantage, particularly suited for personal or professional use in environments where a playful or visually appealing design is desirable.

Figure 6:
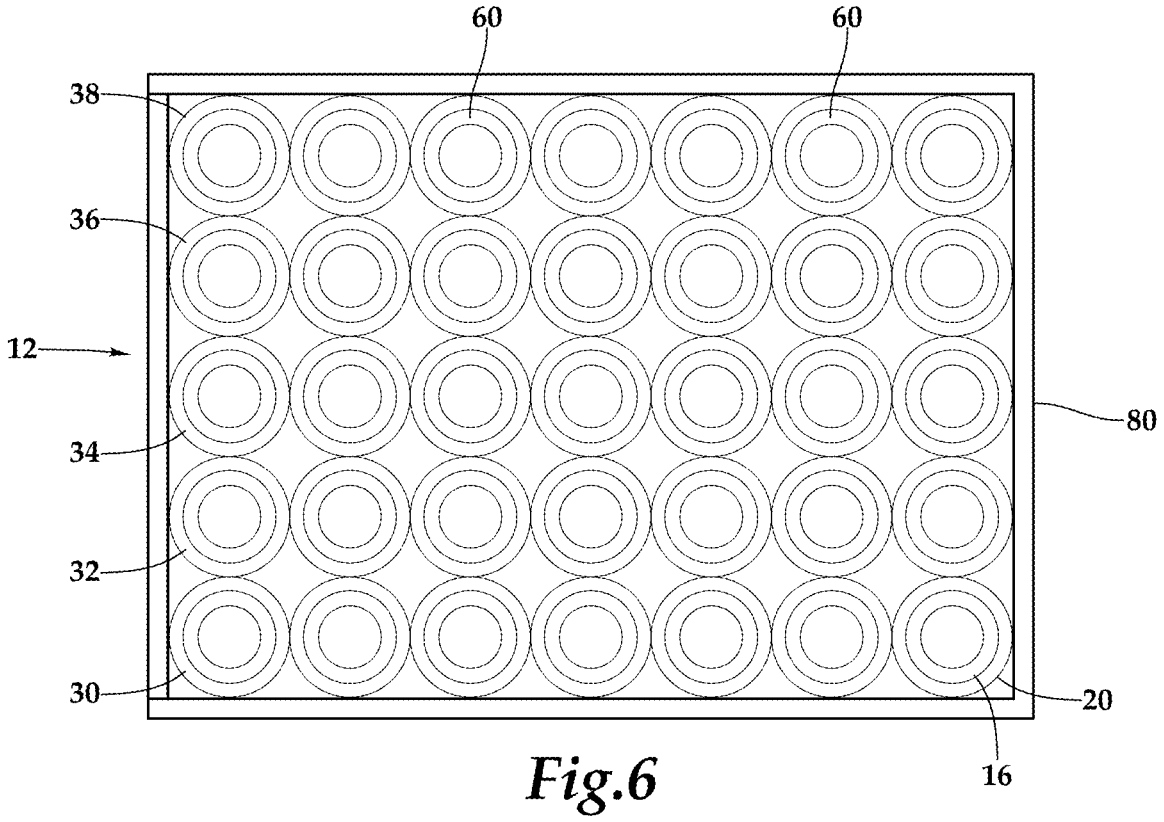
FIG. 6 is a bottom plan view of the apparatus depicted in FIG. 3, in a bead loaded configuration.

In this embodiment, the apparatus 12, while retaining the essential components such the silos 30, 32, 34, 36, 38, the arrays 60 (as shown in FIGS. 1A through 6), a support structure 80, and the removable (not shown), differs primarily in its overall form and the materials used. The silos, numbered 30, 32, 34, 36, 38, for example, in the original embodiment (as shown in FIGS. 1A and 6) and here, are reconfigured to collectively form a portion of a hexagon shape when viewed from above. Each silo retains its individual functionality, including an upper open end and a lower end with an opening, yet their external shapes are adapted to contribute to the overall hexagon contour. The silos can be crafted from various materials including, but not limited to, plastics, metals, or composite materials, with the choice of material influencing the weight, durability, and texture of the apparatus.

The support structure 80, similar to box 82 in the original embodiment, is also redesigned to align with the hexagon-shaped theme. This support structure 80, while providing stability and housing for the silos, can be made from materials such as wood, metal, or high-strength polymers, offering a range of aesthetics from classic to modern. Additionally, a transparent embodiment as shown is possible. The chamber 84 (as shown in FIG. 2) within this support structure 80 is similarly adapted to match the shape, ensuring that the functional aspect of accommodating the flexible loop of the beader tool 14 is retained.

The removable lid, which covers the silos, may also be hexagon-shaped, enhancing the thematic consistency of the design. This lid can be fabricated from, by way of example, transparent or translucent materials like acrylic or tempered glass, allowing a clear view of the silos and the hair beads within, or from opaque materials for a more solid, uniform appearance. The handle affixed to the lid, akin to handle 90 in the original design, is ergonomically designed to complement the hexagon shape, ensuring ease of use and carrying convenience.

This hexagon-shaped embodiment of the apparatus not only serves its primary function of facilitating bead threading, but also adds an element of visual appeal. It can be particularly appealing in settings such as children's hair salons, personal grooming kits, or as a decorative, yet functional, item in a home setting. The use of varying materials and shapes, whether geometric shapes or other shapes like diamonds and hearts, in this design offers a customizable approach, allowing the apparatus to be tailored to specific preferences or branding requirements.

Additionally, the chamber within the support structure, as described in the hexagon-shaped embodiment, may be enhanced by including a drawer integrated within the chamber. This drawer, designed to be easily accessible and user-friendly, can serve as a convenient storage space for extra hair beads, additional beader tools, or other related accessories. The inclusion of such a drawer not only adds to the functionality of the apparatus by providing additional storage, but also contributes to maintaining an organized and efficient work area. This feature is particularly beneficial in professional settings where quick access to various bead types and tools is essential for streamlined operations.

Furthermore, while the hexagon shape offers a unique aesthetic, other embodiments may explore various shapes and configurations for the apparatus and its components. Shapes such as stars, flowers, or geometric patterns can be employed, each bringing a distinct visual appeal and potential ergonomic benefits. In addition to varying the shape of the overall apparatus, individual silos can also be arranged at slight angles, rather than vertically. This angled arrangement can enhance the ease of bead dispensing and improve visibility for the user, making the selection and threading of beads more convenient. Such variations in shape and angle not only cater to personal preferences and stylistic considerations, but also allow for customization based on specific user requirements or the nature of the task at hand. The flexibility in design demonstrates the invention's adaptability and potential for widespread application across different user groups and scenarios.

Figure 9:
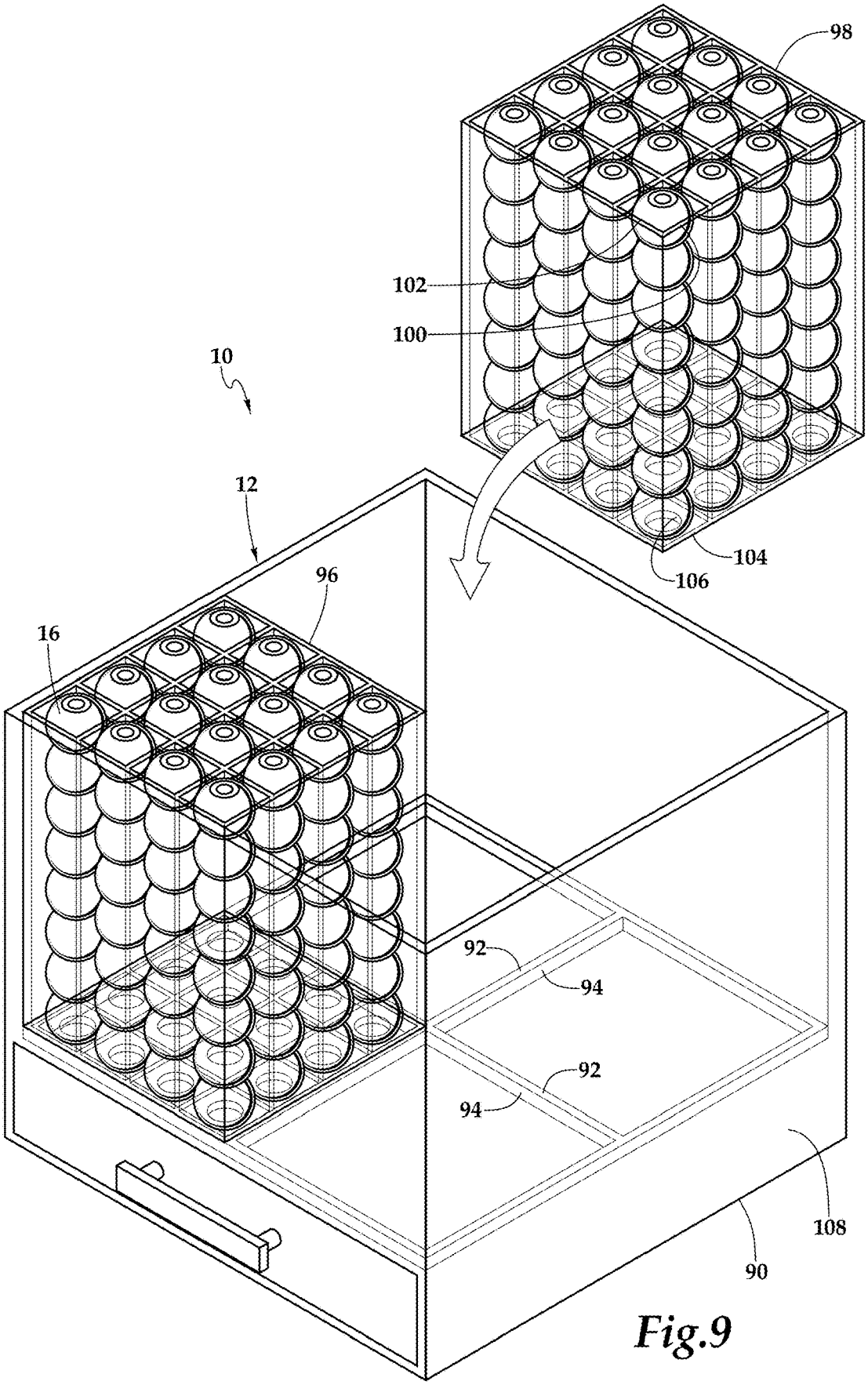
FIG. 9 is a front perspective view of a still further embodiment of an apparatus for threading a beader tool with hair beads.
Figure 10A:
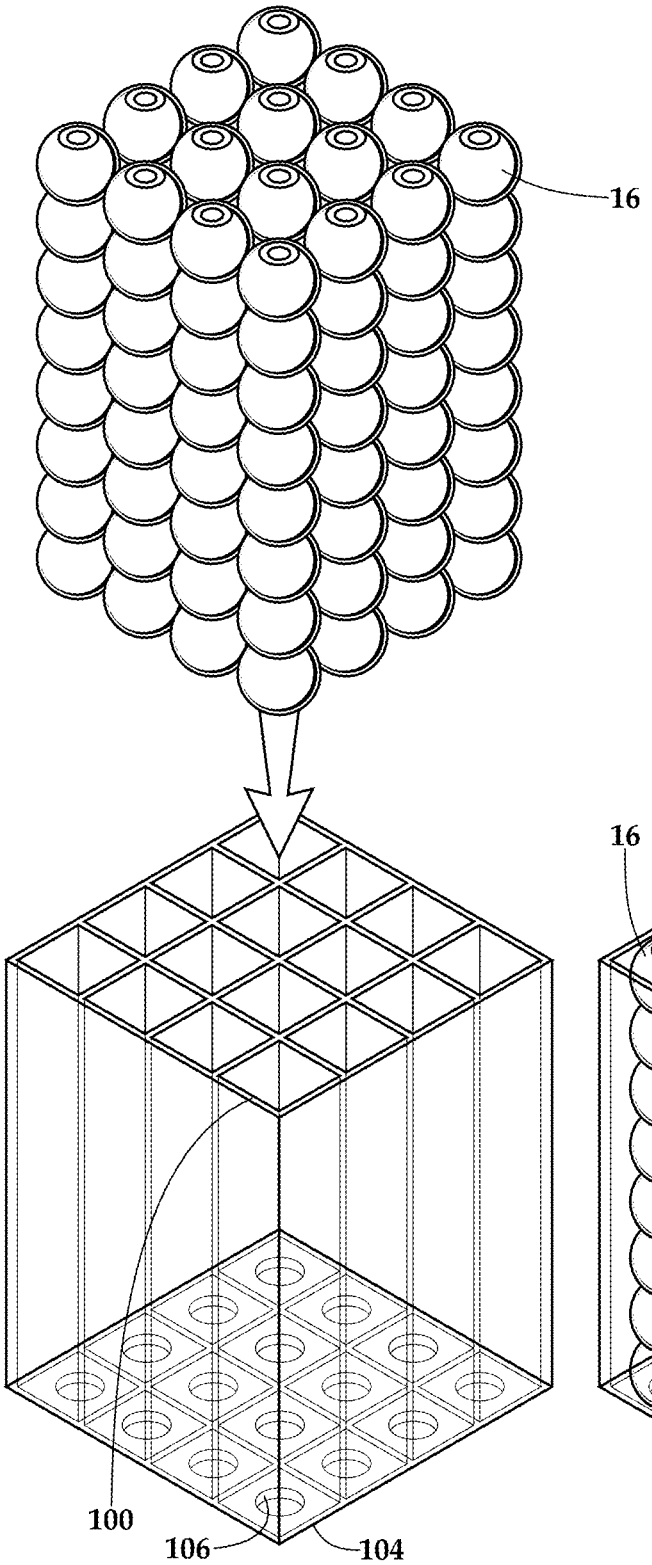
FIG. 10A is a front perspective view of one embodiment of a removable unit, which forms a portion of the apparatus of FIG. 9, being loaded with hair beads.
Figure 10B:
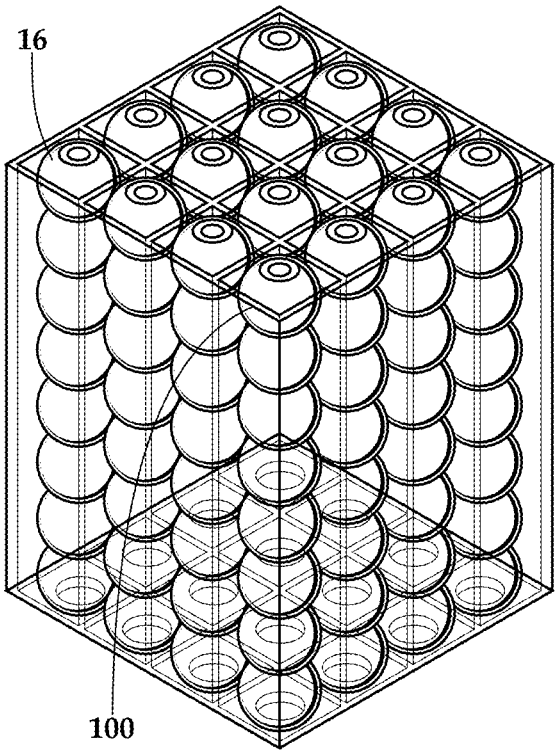
FIG. 10B is a front perspective view the removable unit of FIG. 10A, loaded with hair beads.

Referring now to FIG. 9, FIG. 10A and FIG. 10B, a further embodiment of the system 10 is presented, showcasing the apparatus 12 for threading the beader tool 14 (not shown) with hair beads 16. This embodiment features a support structure 90, uniquely outfitted with a frame 92 that has multiple apertures 94. Atop this frame 92 are positioned selectively removable units, such as removable units 96, 98 each housing arrays of silos. These removable units, as depicted, can include a 4×4 arrangement of 16 silos each. In this configuration, the apparatus 12 is designed to accommodate up to four such units, creating a compact and efficient setup for bead storage and threading.

Each silo in the units, with silo 100 as an example, is designed with an open upper end 102 to allow hair beads 16 to be inserted into its interior, and a closed lower end 104 with an opening 106 just large enough to let the beader tool 14 pass through while retaining the hair beads. The silo openings align with the apertures 94 in the frame 92, ensuring seamless operation. These silos effectively store hair beads 16, providing orderly organization and easy access for threading.

Figure 11:
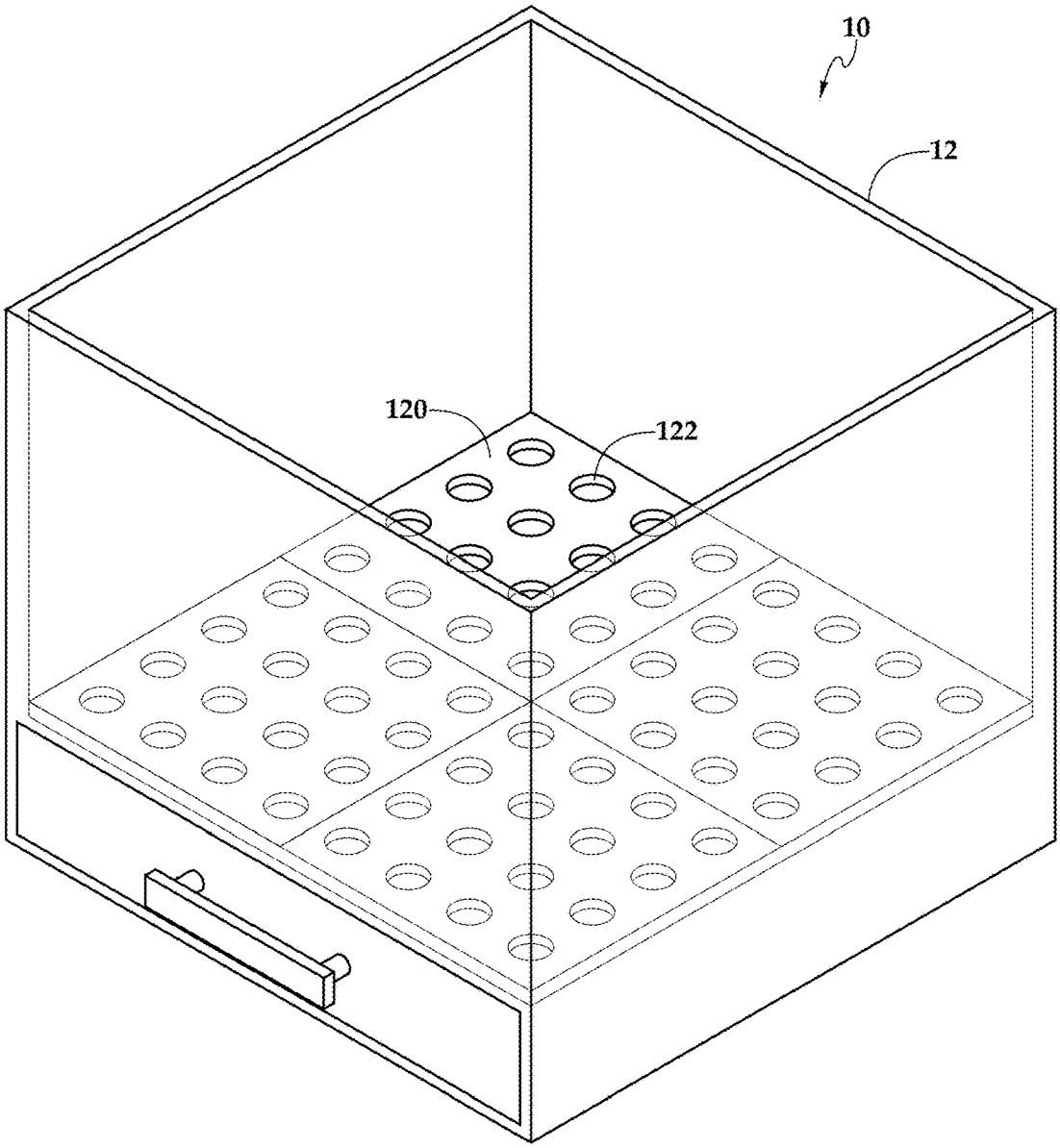
FIG. 11 is a front perspective view of a portion of an alternative embodiment of the apparatus presented in FIG. 9.

Additionally, the support structure 90 includes a chamber 108 beneath the frame 92. This chamber 108 is specifically sized to accommodate at least the flexible loop 24 of the beader tool 14, facilitating efficient use with the apparatus. The design of this embodiment focuses on functional efficiency while preserving user-friendliness. The strategic integration of the frame 92 with the apertures 94 and the underlying chamber 108 simplifies the bead threading process, making it quicker and less labor-intensive than traditional methods. This embodiment enhances the overall utility and adaptability of the system 10 in streamlining the bead threading operation. It should be appreciated, however, that the system 10 may include the apparatus 12 having a plate 120 with holes 122 rather than the frame 92 with the apertures 94 as shown in FIG. 11.

Figure 12A:
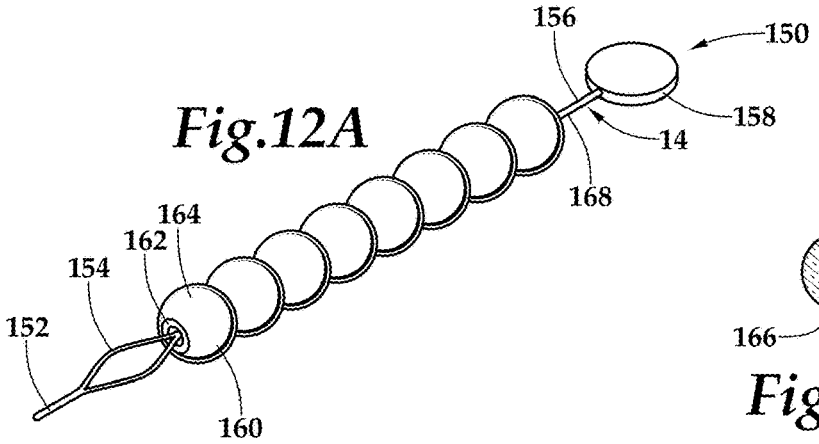
FIG. 12A is a front perspective view of another embodiment of a beader tool and hair beads.
Figure 12B:
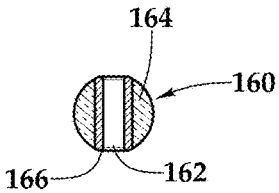
FIG. 12B is a cross-sectional view of one of the hair beads displayed in FIG. 12A.

Referring now to FIGS. 12A and 12B, in some embodiments, a beader tool 150 includes a threading end 152, a flexible loop 154, a shaft 156, and a terminal end 158. The threading end 152 is uniquely crafted for smooth insertion through hair beads 160, while the flexible loop 154 is structured to flexibly widen and narrow, facilitating bead retention during threading. The shaft 156 is proportioned to accommodate a sufficient quantity of the hair beads 160, ensuring a balance between holding capacity and ease of handling. As shown, each of the hair beads 160 has a perforation 162 therethrough and a face 164. In the illustrated embodiment, the perforation 162 has a magnetic treatment 166 thereon. The shaft 156 has a corresponding magnetic treatment 168 thereon such that the hair beads 160 are magnetically attracted to the shaft 156. This magnetic attraction aids in the secure and efficient alignment of the hair beads 160 on the shaft 156, simplifying the bead threading process and enhancing the beader tool's overall functionality. Additionally, the terminal end 158 provides a comfortable grip, allowing for precise control and maneuverability during use.

To further enhance the versatility and adaptability of the present invention, it is envisaged that the components of the system, including the beader tool and the silos, could be made with materials that are environmentally friendly and sustainable. For example, biodegradable plastics or recycled materials can be used for the construction of the silos and the beader tool, reducing the environmental impact. This aspect is particularly important in today's eco-conscious market, where products that align with sustainable practices are increasingly preferred. Additionally, the incorporation of interchangeable parts or modular design elements can be considered. This would allow for the easy replacement of parts subject to wear and tear, such as the threading end of the beader tool or the removable lid of the silos, thereby extending the overall lifespan of the apparatus and reducing waste.

Furthermore, the invention can be adapted for use in a variety of different contexts beyond its primary application in hair beading. For instance, the same principles and mechanisms could be applied to crafting or jewelry-making scenarios, where small beads or components need to be organized and threaded. The adaptability of the silo structure and the beader tool could be modified to accommodate different sizes and types of beads or components, making the system a versatile tool in various creative domains. This adaptability not only extends the utility of the invention, but also opens up potential markets, thereby broadening the scope and commercial viability of the product. Such versatility ensures that the invention remains relevant and useful in a rapidly evolving market, where the demands and applications can diversify over time.

The order of execution or performance of the methods and operations illustrated and described herein is not essential, unless otherwise specified. That is, elements of the methods and flows may be performed in any order, unless otherwise specified, and that the methods may include more or less elements than those disclosed herein. For example, it is contemplated that executing or performing a particular step before, contemporaneously with, or after another step are all possible sequences of execution.

While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

What is claimed is:

1. A system for threading a beader tool with hair beads, the system comprising:

an apparatus for threading a beader tool with hair beads, the apparatus comprising:

a silo having an upper end that is open and sized to permit a hair bead to pass into an interior of the silo, and a lower end that is closed except for an opening therethrough, the opening being sized to permit the beader tool to pass while preventing passage of a hair bead, wherein the interior of the silo is configured to accommodate a plurality of stacked hair beads, and wherein the silo has a height sufficient to receive at least a shaft of the beader tool;

a support structure secured to the silo such that the upper end of the silo is oriented upwardly, the support structure defining a chamber contiguous with and directly beneath the opening so that the opening and the chamber form an unobstructed passage, the chamber having a height sufficient to accommodate at least a loop of the beader tool whereby, during use, the beader tool extends through the opening and into the chamber;

the beader tool having:

a threading end opposite a terminal end, a flexible loop proximate the threading end, and a shaft positioned between the flexible loop and the terminal end; and a plurality of hair beads, each of the plurality of hair beads having a perforation therethrough sized and configured to be threaded onto the shaft of the beader tool, the plurality of hair beads forming the plurality of stacked hair beads in the interior of the silo, wherein the silo, the beader tool, and plurality of hair beads are arranged such that insertion of the beader tool's threading end into the silo and through the plurality of stacked hair beads loads the hair beads onto the shaft for subsequent transfer to hair, wherein the opening meters beads by preventing bead passage while permitting the beader tool and its flexible loop to extend through the opening and into the chamber, whereby the flexible loop is staged within the chamber while beads remain retained in the silo.

2. The system as recited in claim 1, wherein the silo further comprises a shape selected from the group consisting of cylindrical shapes, conical shapes, and cubic shapes.

3. The system as recited in claim 1, where the silo further comprises a transparent material.

4. The system as recited in claim 1, wherein the silo further comprises clear plastic.

5. The system as recited in claim 1, where the opening is positioned in the center of the lower end.

6. The system as recited in claim 1, wherein the support structure further comprises a plurality of walls.

7. The system as recited in claim 1, wherein the support structure further comprises at least one pedestal.

8. A system for threading a beader tool with hair beads, the system comprising:

an apparatus for threading a beader tool with hair beads, the apparatus comprising:

a silo having an upper end that is open and sized to permit a hair bead to pass into an interior of the silo, and a lower end that is closed except for an opening therethrough, the opening being sized to permit the beader tool to pass while preventing passage of a hair bead, wherein the interior of the silo is configured to accommodate a plurality of stacked hair beads, and wherein the silo has a height sufficient to receive at least a shaft of the beader tool;

a support structure secured to the silo such that the upper end of the silo is oriented upwardly, the support structure defining a chamber contiguous with and directly beneath the opening so that the opening and the chamber form an unobstructed passage, the chamber having a height sufficient to accommodate at least a loop of the beader tool whereby, during use, the beader tool extends through the opening and into the chamber;

a removable lid sized and configured to cover the silo, the removable lid having a handle affixed thereto;

the beader tool having:

a threading end opposite a terminal end, a flexible loop proximate the threading end, and a shaft positioned between the flexible loop and the terminal end; and a plurality of hair beads, each of the plurality of hair beads having a perforation therethrough sized and configured to be threaded onto the shaft of the beader tool, the plurality of hair beads forming the plurality of stacked hair beads in the interior of the silo, wherein the silo, the beader tool, and plurality of hair beads are arranged such that insertion of the beader tool's threading end into the silo and through the plurality of stacked hair beads loads the hair beads onto the shaft for subsequent transfer to hair, wherein the opening meters beads by preventing bead passage while permitting the beader tool and its flexible loop to extend through the opening and into the chamber, whereby the flexible loop is staged within the chamber while beads remain retained in the silo.

9. The system as recited in claim 8, wherein the silo further comprises a shape selected from the group consisting of cylindrical shapes, conical shapes, and cubic shapes.

10. The system as recited in claim 8, where the silo further comprises a transparent material.

11. The system as recited in claim 8, wherein the silo further comprises clear plastic.

12. The system as recited in claim 8, where the opening is positioned in the center of the lower end.

13. The system as recited in claim 8, wherein the support structure further comprises a plurality of walls.

14. The system as recited in claim 8, wherein the support structure further comprises at least one pedestal.

15. The system as recited in claim 8, wherein the removable lid comprises a clear plastic enabling visibility of the silo when the lid is in place.

16. A system for threading a beader tool with hair beads, the system comprising:

an apparatus for threading a beader tool with hair beads, the apparatus comprising:

a silo having an upper end that is open and sized to permit a hair bead to pass into an interior of the silo, and a lower end that is closed except for an opening therethrough sized to permit the beader tool to pass while preventing passage of a hair bead, the opening being positioned in the center of the lower end, wherein the interior of the silo is configured to accommodate a plurality of stacked hair beads, and wherein the silo has a height sufficient to receive at least a shaft of the beader tool;

a support structure secured to the silo such that the upper end of the silo is oriented upwardly, the support structure being a box defining a chamber beneath the silo, the chamber having a height sufficient to accommodate at least a loop of the beader tool, the box further comprising a drawer for storing additional items;

a removable lid sized and configured to cover the silos, the removable lid having a handle affixed thereto;

the beader tool having:

a threading end opposite a terminal end, a flexible loop proximate the threading end, and a shaft positioned between the flexible loop and the terminal end; and a plurality of hair beads, each of the plurality of hair beads having a perforation therethrough sized and configured to be threaded onto the shaft of the beader tool, the plurality of hair beads forming the plurality of stacked hair beads in the interior of the silo, wherein the silo, the beader tool, and plurality of hair beads are arranged such that insertion of the beader tool's threading end into the silo and through the plurality of stacked hair beads loads the hair beads onto the shaft for subsequent transfer to hair.

17. The system as recited in claim 16, wherein the silo further comprises a shape selected from the group consisting of cylindrical shapes, conical shapes, and cubic shapes.

18. The system as recited in claim 16, wherein the silo further comprises clear plastic.

19. The system as recited in claim 16, wherein the drawer in the box is positioned along a side of the box and is slidable relative to the support structure to access or store extra beads.

* * * * *